United States Patent [19]

Roy

[11] 4,189,331

[45] Feb. 19, 1980

[54] OXIDATION RESISTANT BARRIER COATED COPPER BASED SUBSTRATE AND METHOD FOR PRODUCING THE SAME

[75] Inventor: Clermont A. Roy, Sherbrooke, Canada

[73] Assignee: Canada Wire and Cable Limited, Toronto, Canada

[21] Appl. No.: 918,269

[22] Filed: Jun. 22, 1978

[51] Int. Cl.[2] ..... C23F 7/02

[52] U.S. Cl. ..... 148/6.31; 148/31.5; 204/37 R; 427/118; 427/419 A; 427/405; 428/469; 428/381; 428/336

[58] Field of Search ..... 148/6.31, 6.3, 31.5; 427/419 A, 405, 118, 79, 80; 428/469, 629, 671, 675, 669, 667, 929, 931; 204/37 R

[56] References Cited

U.S. PATENT DOCUMENTS

| | | | |
|---|---|---|---|
| 1,746,987 | 2/1930 | Bennett | 428/667 |
| 3,069,760 | 12/1962 | Schultz | 428/675 |
| 3,324,280 | 6/1967 | Cheney et al. | 428/675 |
| 3,854,892 | 12/1974 | Burgess et al. | 428/629 |

*Primary Examiner*—Ralph S. Kendall

*Attorney, Agent, or Firm*—Fleit & Jacobson

[57] ABSTRACT

Copper based substrates for use at high temperatures in oxidizing atmospheres are made up of a copper core overlaid with a protective nickel oxide barrier layer formed in situ and an external protective layer of nickel. The process for forming the protective nickel oxide barrier layer comprises the steps of subjecting the copper core to oxidation to form a cuprous oxide surface layer over the copper core, reducing the surface of the cuprous oxide layer to regenerate copper to regain conductivity, plating a surface layer of nickel over the copper layer, and annealing the coated copper core to scavenge at least some of the oxygen from the cuprous oxide layer and react it at the interface with the plated nickel layer to form the protective nickel oxide barrier layer. The oxidation reduction steps may be carried continuously on a copper core which is moved through a reactor having an oxidation zone fed with oxygen, a reduction zone fed with hydrogen and a stabilizer zone separating the oxidation and reduction zones and fed with an inert gas. The reactor is maintained at a temperature such as to allow the oxidation and reduction reactions.

23 Claims, 4 Drawing Figures

OXIDATION RESISTANT BARRIER COATED COPPER BASED SUBSTRATE AND METHOD FOR PRODUCING THE SAME

This invention relates to the forming of copper based substrates for use at high temperatures in oxidizing atmospheres and particularly to copper based substrates which are protected by a composite outer layer having high oxidation resistance.

It is well known that even at 25° C., clear copper surfaces develop thin, adherent layers of copper oxide in less than 1 hour. As the service temperature increases, rapid acceleration of oxidative degradation occurs until at, or about 300° C. damage is so severe as to render the metal unsuitable for use.

In general, two approaches for the protection of a metal from oxidative damage may be followed:

(a) the metal may be alloyed with additions of other metals which induce a stabilization of the matrix or a surface oxide film, produced upon exposure, which is protective; or (b) a coating (i.e. plated, cladded or diffused) may be deposited on the metal to provide protection by limiting the access of oxygen to the substrate.

A commercial high temperature beryllium copper alloy relating to point (a) above was at one time offered which had a service rating of 870° C. This, however, was achieved at the expense of mechanical and electrical properties and is no longer available.

A small number of cladded or plated copper configurations are commercially available, using either nickel or nickel alloy as the sheath. These materials have a service ceiling of about 525° C. and are subject to quite rapid deterioration due to interaction between the copper core and the overlayer. Nickel clad copper showed substantial diffusion between cladding and core and substantial grain growth in the core and cladding. In addition, there was some oxide growth in copper and heavy oxide growth on the nickel surface. Inconel (trade mark of International Nickel Company designating a nickel alloy) clad copper showed substantial diffusion of copper into the nickel alloy clad, microcracking in the nickel alloy layer, heavy grain growth in copper, and cavities at the interface between core and clad.

A single barrier configuration designed to eliminate the problem of oxidative damage or diffusion losses was at one time offered. This involved the introduction of a thin layer of iron between the copper substrate and the nickel outer layer. This material, rated at 750° C., showed serious instability above 525° C. in air, as the iron quickly diffused into both the copper and nickel, causing voids or cavities at the interface with accelerated oxidative breakdown.

The overall problem of producing satisfactory protective coatings over copper, therefore, resolves itself into two principal areas. The first primarily addresses the development of a protective coating composition which will combine with the substrate to form a compatible, useful composite system. The second area entails the function of the coating which is to act as a barrier to prevent access of oxygen to the substrate while itself remaining essentially unchanged through the duration of the exposure of the substrate to the aggressive environment.

Previous approaches to developing protective "diffusion" coatings possessed serious drawbacks in that their processing affected the substrate's mechanical properties, and, because of their direct contact with, and generally strong affinity for, the substrate, they often lack the chemical stability required for the service life of the substrate.

It is therefore the object of the present invention to provide an oxidation resistant barrier coated copper based substrate which has significantly enhanced resistance to oxidative degradation at elevated temperatures and is less subject to contamination at the coating/substrate interface due to the presence of the barrier.

The copper substrate, in accordance with the invention, comprises a copper core overlaid with a protective nickel oxide barrier layer formed in situ and an external protective layer of nickel.

The protective nickel oxide barrier interlayer is preferably between about 1.2 microns and 6 microns and the thickness of the external protective layer of nickel between 2 microns and 24 microns, most preferably between 7 microns and 20 microns.

The process for forming the protective nickel oxide barrier layer comprises the steps of subjecting the copper core to oxidation to form a cuprous oxide surface layer over the copper core, reducing the surface of the cuprous oxide layer to regenerate copper to regain electrical conductivity, plating a surface layer of nickel over the copper layer, and annealing the coated copper core to scavenge at least some of the oxygen from the cuprous oxide layer and react it at the interface with the plated nickel layer to form the protective nickel oxide barrier layer.

The oxidation/reduction steps are preferably carried out continuously on a copper core moving at a speed of between 5 cm/min and 10 cm/min through a reactor having an oxidation zone fed with oxygen, a reduction zone fed with hydrogen, and a stabilizer zone separating the oxidation and reduction zones which is fed with an inert gas, such as argon. The temperature of the oxidation zone is maintained between 755° C. and 1000° C., most preferably at about 760° C. The oxygen supply flow through the oxidation zone is preferably between 1 cc/min and 6 cc/min, most preferably about 2 cc/min. The cuprous oxide layer formed in the above conditions is between 6 microns and 10 microns, most preferably about 8 microns. The reduction zone is preferably maintained at a temperature between 500° C. and 1000° C., most preferably about 750° C. The hydrogen supply flow through the reduction zone is preferably between 0.6 cc/min and 1.5 cc/min, most preferably about 0.85 cc/min. The reduced free copper layer is preferably between 0.7 microns and 1.5 microns, most preferably about 1.2 microns.

The oxygen and hydrogen reactive gas flows noted above provide a partial pressure of about 2 torr and 5 torr respectively in their reactor zones and are preferably mixed with an inert gas such as argon in sufficient quantities to provide a total pressure equal to or slightly above atmospheric pressure. A preferable inert gas flow rate to the oxidation and reduction zones is about 300 cc/min and to the stabilizer zone about 500 cc/min.

The nickel plate layer is preferably between 2 microns and 30 microns, most preferably between 7 microns and 24 microns. It may be applied from an air agitated electrolytic Watts bath composed of nickel chloride, nickel sulfate and boric acid in solution in water. The plating current density is preferably between 0.2 amp/cm$^2$ and 0.32 amp/cm$^2$ with voltage values of from 6 volts to 12 volts. The bath pH may be between 3.5 and 4.5, but should preferably be held close to 4.0. The bath is held at a temperature between 55° C. and 65° C. It is also preferable that the bath be under continuous filtration.

The annealing step to form the nickel oxide interlayer can be performed in air but preferably under either inert gas or vacuum. The annealing procedure preferably includes an initial preheat treatment of from 6 to 1.5 days at between 100° C. and 200° C. The second step of the heat treatment consists of a controlled rise in temperature from 200° C. to about 400° C. over a period of about 12 hrs to 24 hrs followed by a rise in temperature between 400° C. and 1000° C. over a period of 5 hrs to 1.5 hr. The final step of the annealing procedure consists of a cooling period down to room temperature during about 1 hr to 0.2 hr. The final step of the procedure may be initiated immediately upon achieving a temperature which results in initiation of nucleation of the nickel oxide barrier; optionally, the high temperature treatment may be continued for several hours to develop or complete the formation of the NiO barrier.

An apparatus for carrying out the above oxidation/reduction steps preferably comprises a reactor which is divided into an oxidation zone fed with oxygen, a reduction zone fed with hydrogen, and a stabilizer zone separating the oxidation and reduction zones and fed with an inert gas, guide tubes in said reactor for supporting the copper core which is fed sequentially through the oxidation, stabilizer and reduction zones, a tube furnace surrounding the reactor for maintaining a predetermined temperature profile in the three zones of the reactor, and gas lines connected to each zone of the reactor for feeding oxygen to the oxidation zone, hydrogen to the reduction zone and inert gas to the stabilizer zone.

The apparatus is provided with manometers to control the rate of flow of oxygen, hydrogen and inert gases to the respective zones. The oxygen and hydrogen reactive gases are inserted into the oxidation and reduction zones of the reactor in admixture with inert gases as mentioned previously.

The invention will now be disclosed, by way of example, with reference to the accompanying drawings in which.

Many ceramics, particularly oxides, are thermodynamically more stable than metals and thus are less susceptible to interfacial reaction with the metal substrate. However, even the most thermodynamically stable oxides may be induced to interact with metals under certain conditions.

Considering the displacement reaction involving the metals copper and nickel and their lowest oxides, cuprous oxide and nickel oxide, as follows $$Ni + Cu_2O \rightleftharpoons NiO + Cu$$

examination of the Gibbs free energy for this reaction reveals that spontaneous interaction would result from the contact at temperatures of or above 1060° C. of the nickel-cuprous oxide couple. However, at service temperatures of from 525° C. to about 750° C. the Gibbs free energy of reaction would be extremely slow resulting in a relatively stable system, as the cation diffusion in nickel oxide would control the reaction rate rather than the oxygen transport in copper. Thus, it would be possible to create a stable diffusion barrier between copper and an overlayer of nickel which would eliminate oxidative degradation of the substrate at elevated service temperatures.

Figure 1:
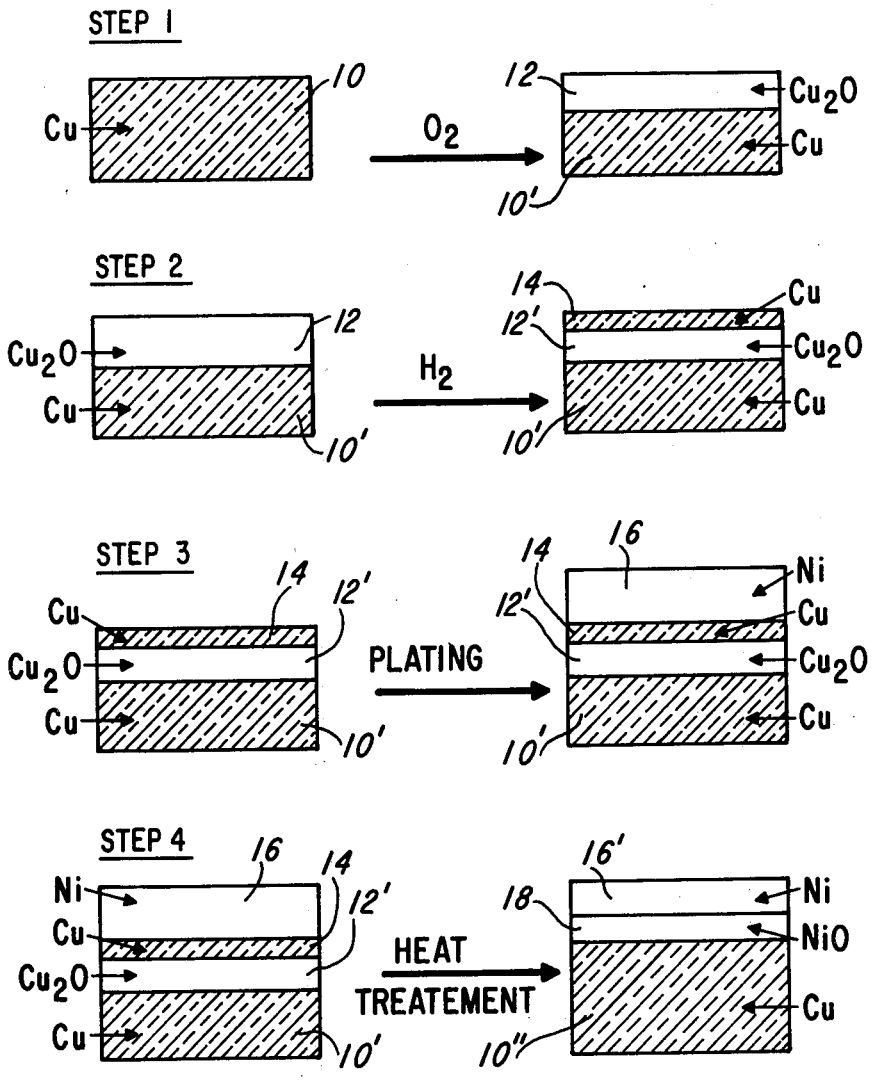
FIG. 1 illustrates a schematic diagram of the steps for forming the protective nickel oxide barrier layer over a copper core.

FIG. 1 illustrates schematically the steps practiced in the present invention to produce a copper based substrate overlaid with a protective nickel oxide barrier layer and an external layer of nickel. In step 1, a copper substrate 10 is surface oxidized to form a cuprous oxide ($Cu_2O$) surface layer 12 over the remaining thickness 10' of copper. In step 2, the surface of the $Cu_2O$ layer is reduced with hydrogen to produce a thin layer 14 of copper over the remaining layer 12' of $Cu_2O$ to regain electrical conductivity. In step 3, a surface layer 16 of nickel is electroplated onto the copper layer 14. In the final step, an in situ interlayer diffusion barrier 18 of NiO is developed by scavenging the oxygen from the cuprous oxide layer 12' and reacting it at the interface with the plated nickel layer to form NiO.

During preliminary experiments, test coupons of copper were heated in vacuo at 800° C. for 2 hours and then oxidized in the same apparatus to produce a 6–10 μm thick oxide film by introducing $O_2$ through a leak valve at a pressure of 1–2 torr. The samples were surface reduced immediately after oxidation, at the temperature of oxidation, in a mixture of 10:1 $Ar/H_2$ gas for 5–10 seconds. This step produced a 1–1.5 μm thick layer of regenerated copper over the oxide film which made the surface conductive. These samples were then coated with a Ni layer of about 15–20 μm thick using a standard electrodeposition procedure. It was found that the oxide film retained its adherence and integrety while the Ni layer had excellent adhesion to the thin surface layer of copper. The Ni-plated samples were heat-treated in vacuo at temperatures of 880°–930° C. for periods of 3 to 8 hours to produce the nickel oxide barrier layer. Metallographic examination clearly revealed a NiO layer between the outer Ni layer and the Cu layer adjacent to the $Cu_2O$ film surface. X-ray diffraction analysis performed on this sample also confirmed the presence of the couple reactions observed metallographically.

A further series of experiments with copper samples consisting of a short oxidation period in a mixture of argon and oxygen followed by a short reduction period in argon and hydrogen were carried out at temperatures varying from about 700° C. to 900° C. Subsequent metallographic study on the sectioned samples enabled correlation of the oxide film thickness formed on the copper core and that of the regenerated copper overcoat with the experimental conditions, i.e. temperature, duration of oxidation and reduction, and partial pressures of oxygen and hydrogen respectively. The preoxidized samples were then plated with nickel and annealed in an inert atmosphere at 900° C. until a diffusion barrier was formed. From the above experiments, it became possible to more clearly derive semi-optimum conditions for the practice of the invention; subsequent studies applied this information to the protection of continuous copper substrates.

Figure 2:
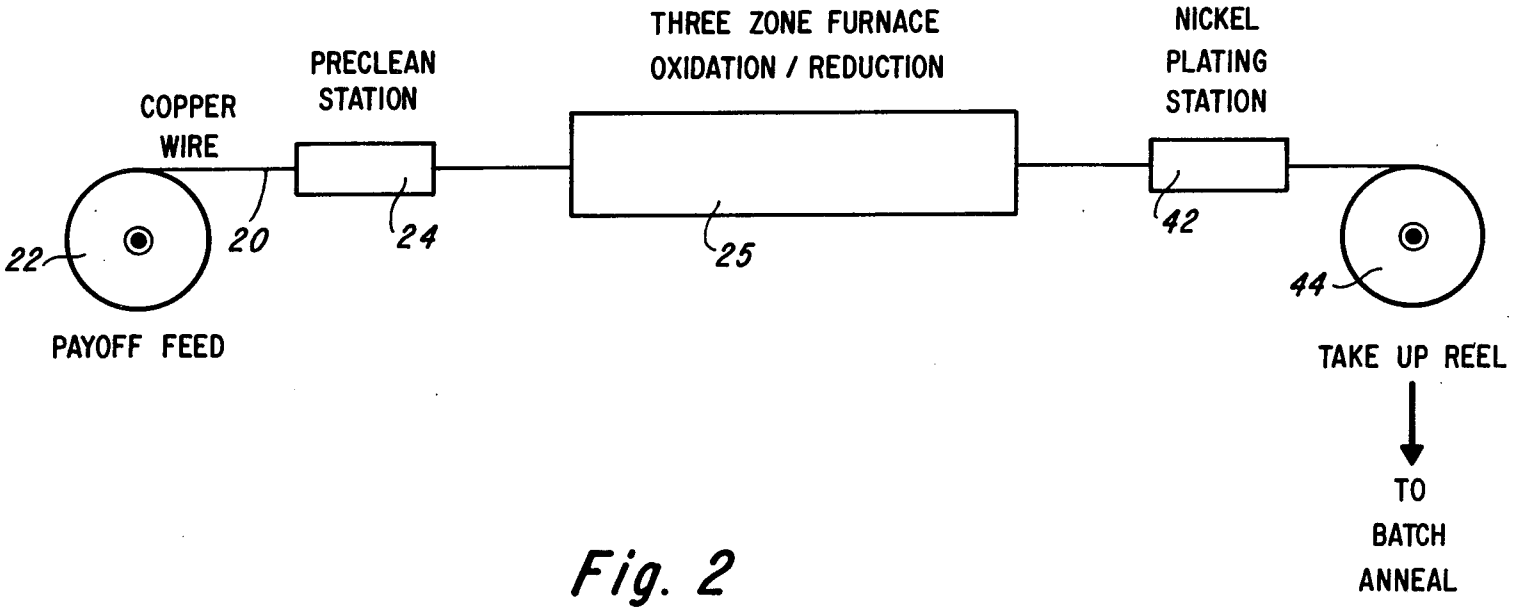
FIG. 2 illustrates a general schematic diagram of an apparatus for carrying out continuous oxidation and reduction on a copper core.
Figure 3:
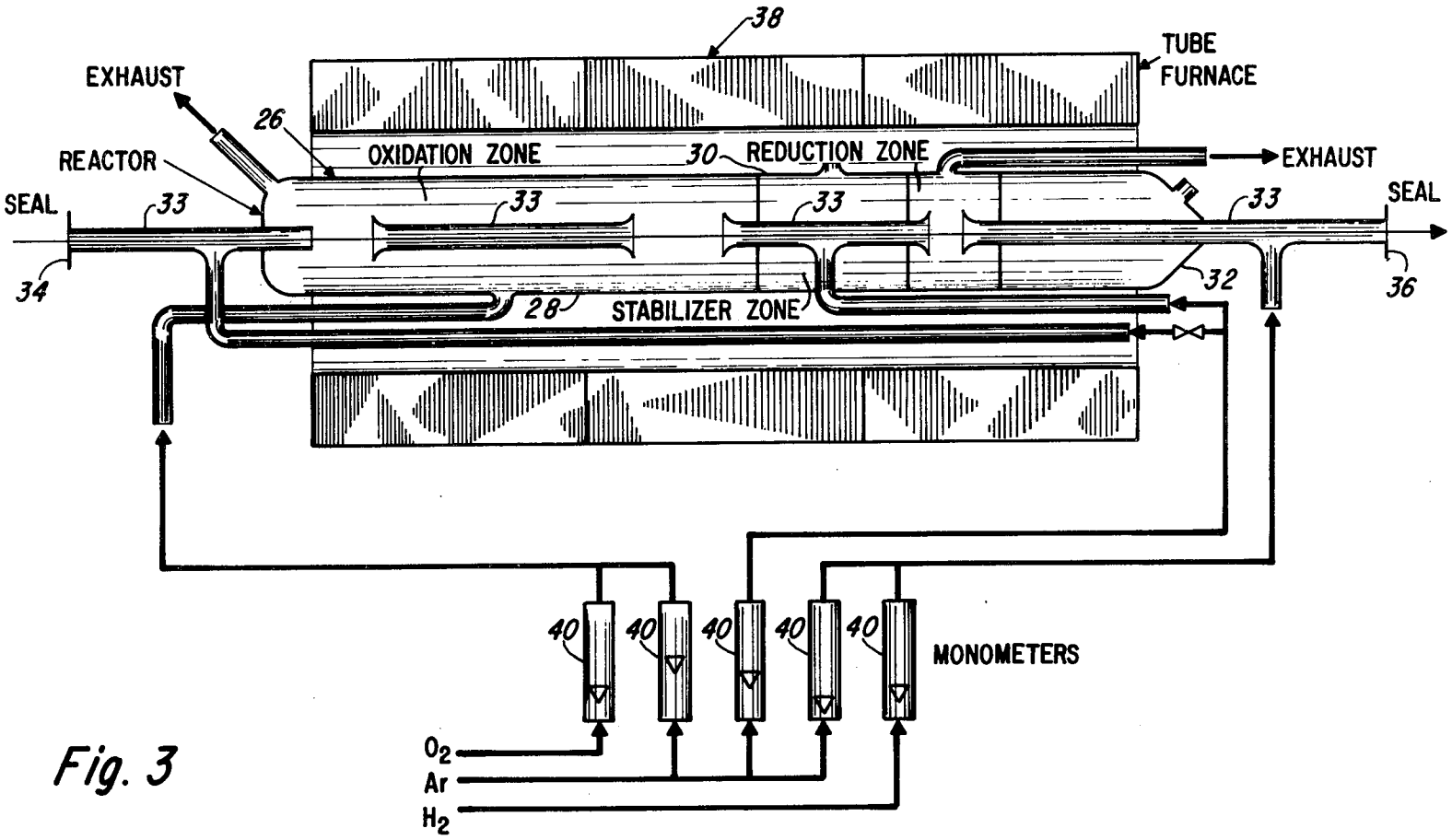
FIG. 3 illustrates a specific embodiment of the invention for carrying out the oxidation/reduction of the copper core.

FIGS. 2 and 3 illustrate, respectively, a general schematic of an apparatus for the continuous formation of the above protective nickel oxide barrier over a copper wire which is continuously passed through an apparatus in accordance with a non-restrictive embodiment of the invention. In FIG. 2, a copper wire 20 is fed from a payoff reel 22 into a pre-clean station 24 to remove oils, dirt, etc. This station may optionally be an ultrasonic cleaner, and could contain any acceptable industrial cleaning fluids. From there the wire passes through a three zone furnace 25 which performs the oxidation/reduction steps 1 and 2 of FIG. 1. Referring to FIG. 3, the wire passes through a quartz reactor 26 which is divided into three zones, an oxidation zone 28, a stabilizer zone 30, and a reduction zone 32. The wire is supported by discontinuous guide tubes illustrated schematically by reference No. 33 and mechanical seals 34 and 36 are provided at the inlet and outlet of the reactor to prevent egress of gases from the reactor. Surrounding the reactor is a three zone tube furnace 38 with appropriate controls (not shown) to provide the required heat to each of the oxidation, stabilizer and reduction zones. Manometers 40 control the flow of gases into each of the zones. Argon gas is metered into the inlet of the reactor so as to effect a positive pressure seal against ingress of air through the input mechanical seal 34. An appropriate mixture of oxygen and argon is metered into the oxidation zone 28 where the cuprous oxide surface layer is formed. Argon under positive pressure is fed to stabilizer zone 30 to ensure no mixing of the reactive gases in the oxidation and reduction zones. Finally, a metered flow of hydrogen and argon is fed to the reduction zone 32.

Referring back to FIG. 2, the wire then passes into a plating station 42 where an appropriate thickness of nickel is applied thereto electrolytically (step 4 of FIG. 1). The wire is also rinsed and dried in the plating station before being collected on a take-up reel 44 which is powered by a motor (not shown) to draw the wire through the apparatus at a speed between 5 and 10 cm/min preferably about 8 cm/min. From there, the treated wire is transported to a suitable furnace and subjected to a vacuum or inert gas anneal under a specific temperature profile in order to effect the formation of the nickel oxide barrier layer (step 4 of FIG. 1).

Oxygen gas flow into the oxidation zone of the furnace is between 1 cc/min and 6 cc/min, preferably about 2 cc/min. The temperature maintained in the oxidation zone is in the range of 755° C. to 1000° C., preferably about 760° C. Under the above conditions, the cuprous oxide layer formed on top of the substrate is between 6 and 10 microns.

The hydrogen gas flow to the reduction zone of the furnace is between 0.6 cc/min and 1.5 cc/min, preferably above 0.85 cc/min in order to produce by reduction a thin layer of copper over the cuprous oxide layer so as to regain conductivity. The temperature of the reduction zone is about the same as the temperature of the oxidation zone although it is preferable that the oxidation zone be maintained at a slightly higher temperature than the reduction zone. Under the above conditions, the thickness of regenerated copper over the cuprous oxide is between 0.7 microns and 1.5 microns, preferably about 1.2 microns. At an hydrogen flow lower than 0.8 cc/min, the copper layer peels off in certain spots. If the hydrogen flow is higher than 1.0 cc/min, it has been noted that the thickness of the layer influences the behavior of the wire when it is later submitted to the heat treatments. Indeed, it has been found that the thicker the copper layer, the higher are the chances of the final coating to swell.

The argon flow to the oxidation and reduction zones should be about 300 cc/min and to the stabilizer zone about 500 cc/min. The temperature of the stabilizer zone 30 of the furnace is preferably maintained at about the same level as in the reduction zone.

As mentioned previously, upon leaving the oxidation/reduction furnace, the wire is fed to a plating station. The nickel plate layer applied to the wire should preferably be from 2 microns to 30 microns, most preferably between 7 and 24 microns. Although various baths may be used, the electrolytic solution used by the applicant has been so-called Watts bath composed of nickel chloride, nickel sulfate and boric acid in solution in water. The bath should preferably be agitated and maintained at a temperature in the range of 55° C. to 65° C. Plating current requirements may vary from between 0.2 amp/cm$^2$ to 0.32 amp/cm$^2$ with voltage values of from 6 volts to 12 volts. The bath pH may be from 3.5 to 4.5 but should preferably be about 4.0. It is also preferred that the bath be maintained under continuous filtration.

The annealing sequence to form the nickel oxide interlayer can be performed in air but is preferably done under either inert gas or vacuum, preferably with a preheat cycle of from 6 days to 1.5 day at a temperature between 100° C. and 200° C. The temperature is then increased from about 200° C. to 400° C. over a period of 12 hrs to 24 hrs. Following this, the substrate is then subjected to a rise in temperature from 400° C. to 1000° C. for between 5 hrs to 1.5 hr. If it is preferred that only nucleation of the NiO layer occurs, the substrate is then cooled from the annealing temperature to ambient temperature over a period of 1 hr to 0.2 hr. If it is desired to further develop or complete the formation of the NiO barrier, the high temperature treatment is continued for several hours.

One preferred combination of conditions for carrying out the process in accordance with the invention, using a copper wire substrate is disclosed in the following Table I:

TABLE I

| OXIDATION ZONE | STABILIZER ZONE | REDUCTION ZONE | PLATING BATH* | THERMAL ANNEAL |
|---|---|---|---|---|
| Temperature 700° C. | Temperature 750° C. | Temperature 750° C. | Current 0.28 A/cm$^2$ | Atmosphere Argon |
| Oxygen 2 cc/min | Argon 500 cc/min | Hydrogen 0.85 cc/min | Voltage 6–12 | Preheat 200° C./2 days |
| Argon 295 cc/min | | Argon 295 cc/min | S.G. 1.21 | Heat up 200° C. to 400° C./ 1 day |
| | | | pH 4.0 | Anneal 400° C. to 800° C./ 1 hour |
| | | | Bath Temp. 65° C. | Cooling 800° C. to 25° C./ |

TABLE I-continued

| OXIDATION ZONE | STABILIZER ZONE | REDUCTION ZONE | PLATING BATH* | THERMAL ANNEAL |
|---|---|---|---|---|
| | | | | ½ hour |

*Bath Compositions:
Nickel Sulphate, $N_iSO_4 . 6 4_2 0$ : 44 oz/gal
Nickel Chloride, $N_iCl_2 . 6 4_2 0$ : 6 oz/gal
Boric Acid : 5 oz/gal Subject to the conditions of Table I, a cuprous oxide layer of 8 microns was formed on a copper wire substrate running at 8 cm/min. About 1.25 microns of reduced copper was formed in the reduction zone. About 18 microns of nickel was subsequently plated on and a barrier zone of about 2.5 microns of nickel oxide was formed during the annealing step.

Further experiments were done to optimize the oxidation/reduction step by varying the oxygen and/or hydrogen flow rates and the temperature of the three zones. This caused alterations in the relative thicknesses of the cuprous oxide formed as well as the thickness of the reduced copper on top of the cuprous oxide layer, which in turn affected the adhesion of the subsequently applied nickel layer as well as the integrity of the final vacuum annealed wire. Various annealing procedures were also tried. It is consistent with our experience that nickel oxide barrier needs only be nucleated during the annealing procedure and may continue to develop to completion during service. It will also be understood that the thickness of the nickel oxide barrier depends also on the anneal temperature and the time during which the sample is subjected to anneal at high temperature.

Stability tests on the nickel oxide interlayer were performed under vacuum at high temperature. Metallographic examination of the samples after a specified number of hours of exposure has given the results of the following Table II:

TABLE II

| SAMPLE No. | TEMP. °C. | HOURS EXPOSURE | $Cu_2O$ THICKNESS (Microns) | NiO THICKNESS (Microns) |
|---|---|---|---|---|
| 1 | 800 | 28.75 | 1.24 | 3.03 |

TABLE II-continued

| SAMPLE No. | TEMP. °C. | HOURS EXPOSURE | $Cu_2O$ THICKNESS (Microns) | NiO THICKNESS (Microns) |
|---|---|---|---|---|
| | | 93 | 0.88 | 2.35 |
| | | 113 | 0 | 2.33 |
| | | 430 | 0 | 3.00 |
| 2 | 800 | 24 | 1.52 | 1.95 |
| | | 134 | 0 | 3.77 |
| | | 199 | 0 | 3.5 |
| 3 | 800 | 21 | 4.65 | 1.38 |
| | | 39 | 3.14 | 2.24 |
| | | 61 | 1.15 | 3.52 |
| | | 166 | 0 | 5.51 |
| 4 | 850 | 4 | 4.43 | 1.14 |
| | | 8 | 3.61 | 1.27 |
| | | 16 | 2.97 | 2.28 |
| 5 | 950 | 0.5 | 2.73 | 1.85 |
| | | 2.0 | 1.65 | 2.11 |
| | | 4.0 | 0 | 3.45 |

The results of Table II show that a nickel oxide interlayer is present and that, once the layer is initiated, it may be completed during service.

Figure 4:
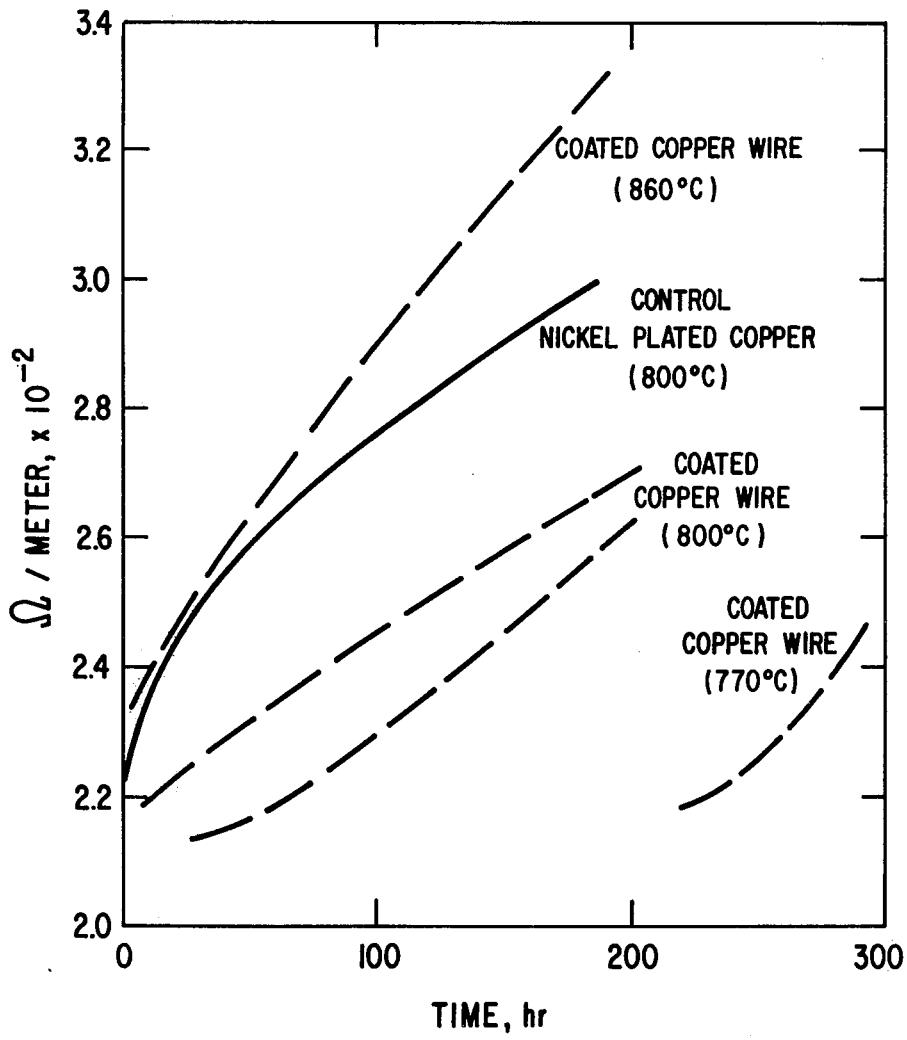
FIG. 4 illustrates a graph of the electrical resistivity versus time exposure of various samples of oxidation resistant barrier coated copper based substrates in accordance with the invention in comparison to a commercial nickel clad copper substrate control.

FIG. 4 illustrates the superior stability of a copper wire protected by the surface treatment of the invention when tested for electrical resistivity at various extremely high temperatures in vacuum. It can be clearly seen, in comparison to a commercial nickel clad copper wire control, that the experimental wires retained a superior measure of conductivity, due to the substantial reduction in intermetallic diffusion.

Samples of various copper wire, including the one protected by practicing the invention, where held at 677° C. in air in a convection muffle furnace and examined periodically both for both gross visual changes and microscopic changes by metallography and the results of such tests are illustrated in the following Table III:

TABLE III

| CONDUCTOR CONFIGURATION | CONDITION AFTER 1000 HOURS at 677° C. in air |
|---|---|
| Nickel Clad Copper | Substantial diffusion between cladding and core. Substantial grain growth in core and cladding. Some oxide growth in copper, heavy oxide growth on nickel surface. |
| Inconel Clad Copper | Substantial diffusion of copper into Inconel clad. Microcracking in Inconel layer. Heavy grain growth in copper, evidence of cavities at interface between core and clad. Slight embrittlement of wire. Slight oxidation of Inconel surface. |
| Inconel Clad Silver | No visual oxide growth or interdiffusion between silver and Inconel. Significant grain growth in silver core. Cladding stable, slight oxidation of Inconel surface. |
| Nickel clad copper with Iron barrier interlayer | Failed within 500 hours of exposure. Nickel-iron diffusion excessive and brittle. Cladding failed by spalling during cooling for examination. |
| Copper | Failed by complete oxidative degra- |

TABLE III-continued

| CONDUCTOR CONFIGURATION | CONDITION AFTER 1000 HOURS at 677° C. in air |
|---|---|
| | dation within 25 hours. |
| Nickel clad copper with nickel oxide barrier inter-layer (formed by practicing anneal of Table I) | No diffusion between copper and nickel oxide or nickel oxide and nickel. Some grain growth in copper core and nickel outer layer. Heavy oxide growth on nickel surface (estimate ~25% of cross section thickness). |

The above Table III shows that in comparison to commercial controls and other experimental wires, the wire of the present invention is much superior to known products and had similar performance properties to an Inconel alloy protected silver cored wire of significantly higher cost, rated to 850° C.

Although the invention has been disclosed with reference to a preferred apparatus for carrying out continuous process on a copper core, it is to be understood that the process for forming the protective nickel oxide barrier layer could be done in a batch manner on discrete copper substrates and that the invention is to be limited by the scope of the claims only.

The embodiments of the invention in which an exclusive property or privilege is claimed are defined as follows:

1. A copper substrate comprising a copper core, a protective nickel oxide barrier formed in situ directly in contact with the copper core and a protective layer of nickel directly in contact with the nickel oxide barrier layer.

2. A copper substrate as defined in claim 1, wherein the nickel oxide barrier layer is between 1.2 microns and 6 microns in thickness.

3. A copper substrate as defined in claim 1, wherein the protective layer of nickel is between 2 microns and 24 microns in thickness.

4. A copper substrate as defined in claim 3, wherein the protective layer of nickel is about 18 microns in thickness.

5. A process for forming a protective nickel oxide barrier layer over a copper core comprising the steps of:

(a) subjecting the copper core to oxidation to form a cuprous oxide surface layer over the copper core;

(b) reducing the surface of the cuprous oxide layer to regenerate copper to regain electrical conductivity;

(c) plating a surface layer of nickel over the free copper layer; and (d) annealing the coated copper wire to scavenge at least some of the oxygen from the cuprous oxide layer and react it with the plated nickel layer to form the protective nickel oxide barrier layer.

6. A process as defined in claim 5, wherein the oxidation/reduction steps are carried out continuously on a copper core which is moved at a speed between 5 and 10 cm/min through a reactor having an oxidation zone fed with oxygen, a reduction zone fed with hydrogen and a stabilizer zone separating said oxidation and reduction zones which is fed with an inert gas.

7. A process as defined in claim 6, wherein oxidation is carried out at a temperature between 755° C. and 1000° C., with an oxygen flow through the oxidation zone between 1 cc/min and 6 cc/min to produce a cuprous oxide layer between 6 microns and 10 microns in thickness.

8. A process as defined in claim 7, wherein oxidation is carried out at a temperature between 750° C. and 1000° C. with an oxygen flow of about 2 cc/min to produce a cuprous oxide layer of about 8 microns in thickness.

9. A process as defined in claim 6, wherein reduction is carried out in the reduction zone at a temperature between 500° C. and 1000° C., with an hydrogen flow through the reduction zone between 0.6 cc/min and 1.5 cc/min to produce a free copper layer between 0.7 microns and 1.5 microns in thickness over the cuprous oxide layer.

10. A process as defined in claim 9, wherein reduction is carried out at a temperature between 700° C. and 1000° C., with an hydrogen flow of about 0.85 cc/min to produce a regenerated copper layer of about 1.2 microns over the cuprous oxide layer.

11. A process as defined in claim 6, wherein an inert gas is mixed with the oxygen and hydrogen to provide a total pressure equal to or slightly above atmospheric pressure.

12. A process as defined in claim 6, wherein the inert gas flow to the oxidation and reduction zones is about 300 cc/min and to the stabilizer zone about 500 cc/min.

13. A process as defined in claim 6, wherein the bath is air agitated and maintained under continuous filtration.

14. A process as defined in claim 5, wherein the nickel plate layer is between 2 microns and 30 microns.

15. A process as defined in claim 14, wherein the nickel plate layer is applied from an electrolytic Watts bath composed of nickel chloride, nickel sulphate and boric acid in solution in water, the plating current density being between 0.2 amp/cm$^2$ and 0.32 amp/cm$^2$ with voltage values between 6 volts to 12 volts, the bath pH being between 3.5 and 4.5 and the bath temperature between 55° C. and 65° C.

16. A process as defined in claim 5, wherein the annealing step is carried out in air or under inert gas or vacuum.

17. A process as defined in claim 16, wherein annealing includes a first initial heat treatment of from 6 to 1.5 days at between 100° C. and 200° C., a second heat treatment step from about 200° C. to about 400° C. over a period of 12 to 24 hrs followed by a rise in temperature between 400° C. and 1000° C. over a period of from 5 hrs to 1.5 hrs, and finally a third cooling step down to room temperature lasting between 1 hr and 0.2 hr.

18. A process as defined in claim 16, wherein annealing includes a first initial heat treatment of about 2 days at about 200° C., a second heat treatment step from about 200° C. to about 400° C. over a period of about 24 hrs followed by a rise in temperature between 400° C. and 1000° C. over a period of about 1 hr and a third cooling step down to ambient temperature over a period of about 0.5 hr.

19. A process as defined in claims 17 or 18 wherein the third step is initiated immediately upon achieving a temperature in the range of 400° C. to 1000° C. which results in initiation of nucleation of the nickel oxide barrier.

20. A process as defined in claims 17 or 18, wherein the high temperature treatment is continued for several hours to develop or complete the formation of the NiO barrier.

21. A copper substrate comprising a copper core, a cuprous oxide layer directly in contact with the copper core, a copper layer directly in contact with the cuprous oxide layer, a protective nickel oxide barrier layer formed in situ directly in contact with the copper layer and a protective layer of nickel directly in contact with the nickel oxide barrier layer.

22. The copper substrate as defined in claim 21, wherein the nickel oxide barrier layer is between 1.2 microns and 6 microns in thickness.

23. A copper substrate as defined in claim 21, wherein the protective layer of nickel is between 2 microns and 24 microns in thickness.

* * * * *